US005839903A

United States Patent [19]

Thompson et al.

[11] Patent Number: 5,839,903

[45] **Date of Patent: *Nov. 24, 1998**

[54] PLAYING AID STRIPS

[76] Inventors: Gary Thompson; Mike Blackburn, both of P.O. Box 8185, Fremont, Calif. 94537-8185

[ * ] Notice: The term of this patent shall not extend beyond the expiration date of Pat. No. 5,613,855.

[21] Appl. No.: 823,274

[22] Filed: Mar. 24, 1997

Related U.S. Application Data

[63] Continuation-in-part of Ser. No. 499,757, Jul. 7, 1995, Pat. No. 5,613,855.

[51] Int. Cl.[6] ..... A63B 69/00

[52] U.S. Cl. ..... 434/247; 482/14; 473/490; 473/438

[58] Field of Search ..... 434/187, 251, 434/255, 258, 247, 97; 472/92; 482/14, 15; 473/438, 490, 440, 459

[56] References Cited

U.S. PATENT DOCUMENTS

| | | | |
|---|---|---|---|
| 1,605,662 | 11/1926 | Kayser | 473/490 |
| 1,897,801 | 2/1933 | Healy | 473/490 |
| 1,986,941 | 1/1935 | Pearson | 473/490 |

*Primary Examiner*—Todd E. Manahan
*Attorney, Agent, or Firm*—The Kline Law Firm

[57] ABSTRACT

A modular playing aid strip that a user can join in any conformation desired. The strips are joined together by grommets and anchors and/or by Velcro. The strips can be easily removed from the playing surface, so that the user can quickly and easily change the layout. The strips are easy to store and transport.

7 Claims, 8 Drawing Sheets

PLAYING AID STRIPS

BACKGROUND AND FIELD OF THE INVENTION

This application is a continuation-in-part of U.S. application Ser. No. 08/499,757, filed Jul. 07, 1995, to be issued as U.S. Pat. No. 5,613,855 on Mar. 25,1997. The invention relates to the art of training athletes. One of the major goals in training and evaluating athletes in all sports, especially football players, is to develop speed, coordination, lateral movement, peripheral vision, and the ability to quickly change direction, also known as cutting.

Although a number of prior devices have been developed for teaching and evaluating athletes on indoor and outdoor playing surfaces of grass and artificial turf, such devices have utilized cones, boards, or other means of positioning of objects and or player athletes (See U.S. Pat. Nos. 4,645,458; 4,047,308; and 2,458,984.)

These traditional approaches used in the prior art for training individuals in the proper techniques for playing football and other sports have several deficiencies, namely, lack of accuracy, extensive set up time, and excessive storage space requirements.

One advantage of the present invention, which is made of flexible elongated materials, is that when it is used as a directional strip or positioning aid, the device can be laid out for specific routes, pass drops, drills, and/or outlining playing fields. Sections of strips may be snapped together by Velcro or grommets to indicate unlimited routes, pass drops, drills, and various playing field designs. The present invention, unlike any prior art, teaches a player in a simple and accurate manner the exact direction he or she should move on any given play or exercise.

Another advantage of the present invention is that it allows set-up of training, timing and practice areas in less time than is required with prior art devices, and it can also be used to mark such areas with precise measurements time after time without error or deviation.

A further advantage of the present invention is that it is light in weight and can be snapped apart very quickly for convenient storage. Currently, heavy awkward orange cones are used to mark training, timing and practice areas.

OBJECTIVE AND SUMMARY OF THE INVENTION

One objective of the present invention is to provide an improved (football) training aid which is greatly simplified from the training aids disclosed in the prior art. The present invention also provides a training aid which will enable a novice to develop speed, coordination, lateral movement, peripheral vision, the ability to quickly change direction, also known as cutting, and the ability to develop his or her own natural talent and agility.

In summary, the present invention is a modular playing aid strip. The strips can be joined in any conformation desired by the user. The strips can be easily removed from the playing surface, so that the user can quickly change the layout. The strips are easy to store and transport.

These and other objectives and advantages of the present invention will become more apparent to those skilled in the art from the detailed drawings attached. However, the detailed drawings and specific examples illustrated in the drawings, while indicating preferred embodiments of the present invention, are given by way of illustration only since various changes and modifications within the spirit and scope of the present invention are possible.

BEST MODE OF CARRYING OUT THE INVENTION

The present invention is a playing aid strip 10. The strip 10 is constructed to simulate line markers on a playing field, and is therefore generally rectangular in shape.

Figure 1:
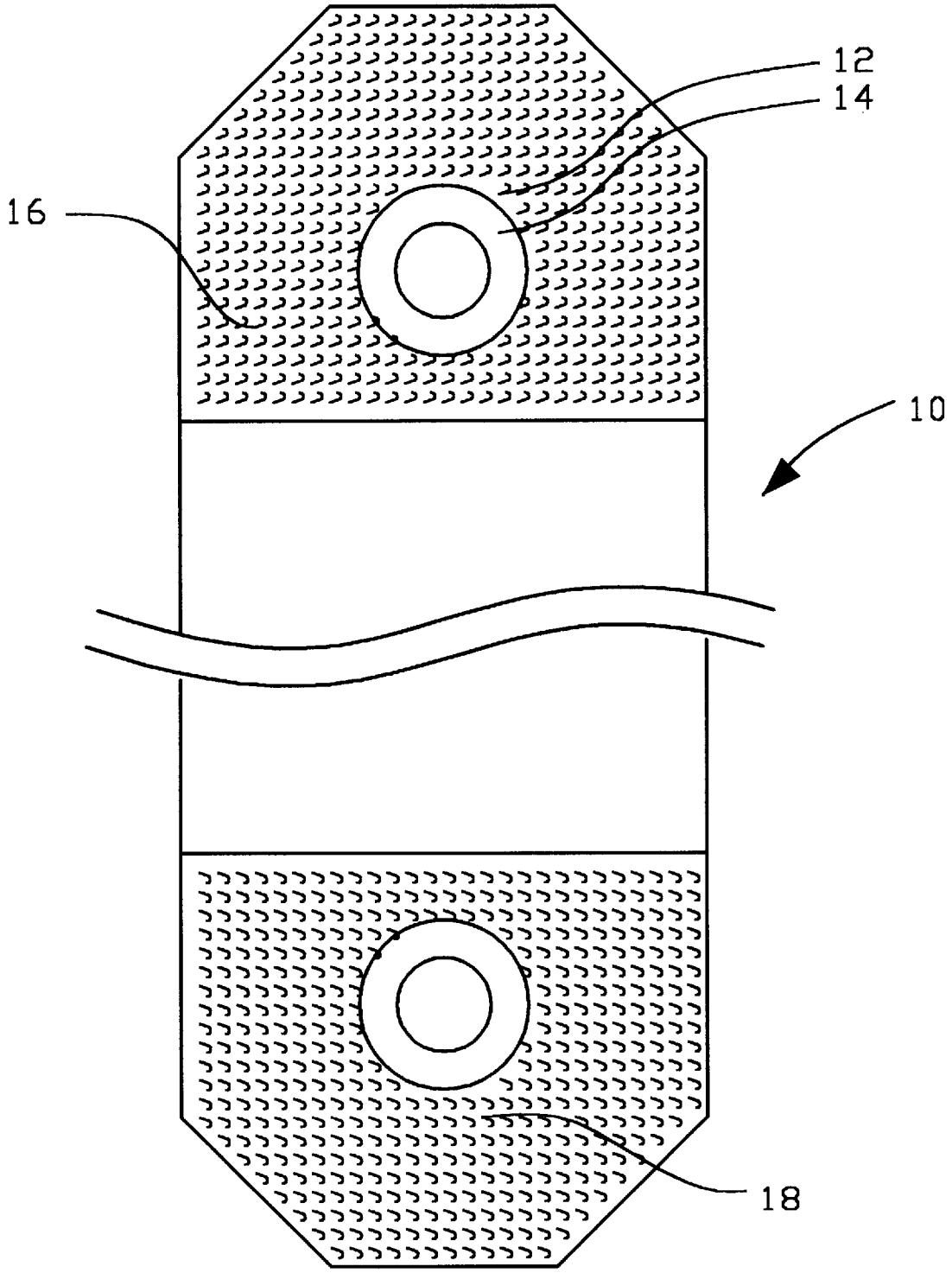
FIG. 1 is a broken top view of the playing aid strip of the present invention.
Figure 2:
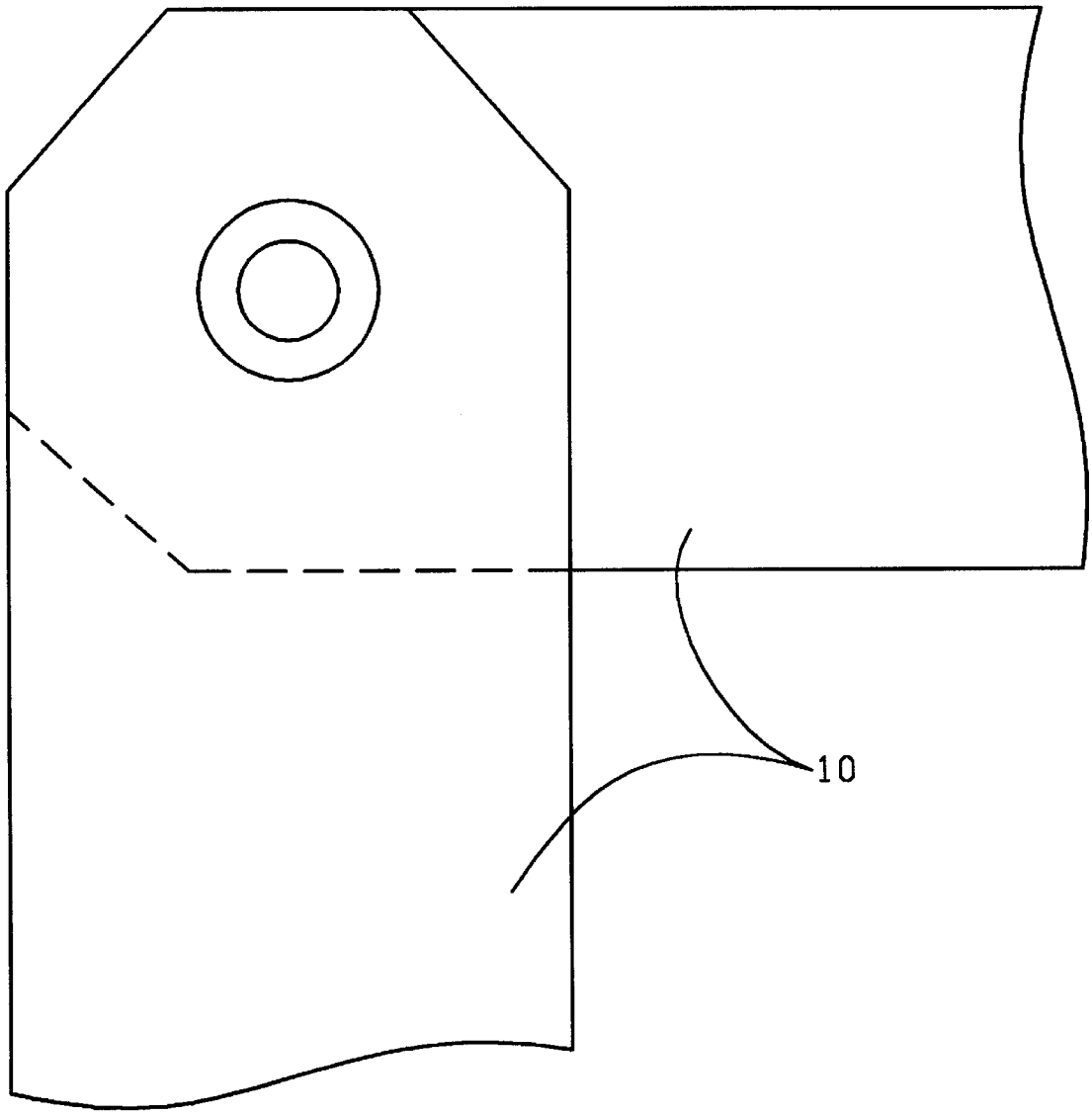
FIG. 2 is a broken view of two strips joined at a ninety degree angle.
Figure 3:
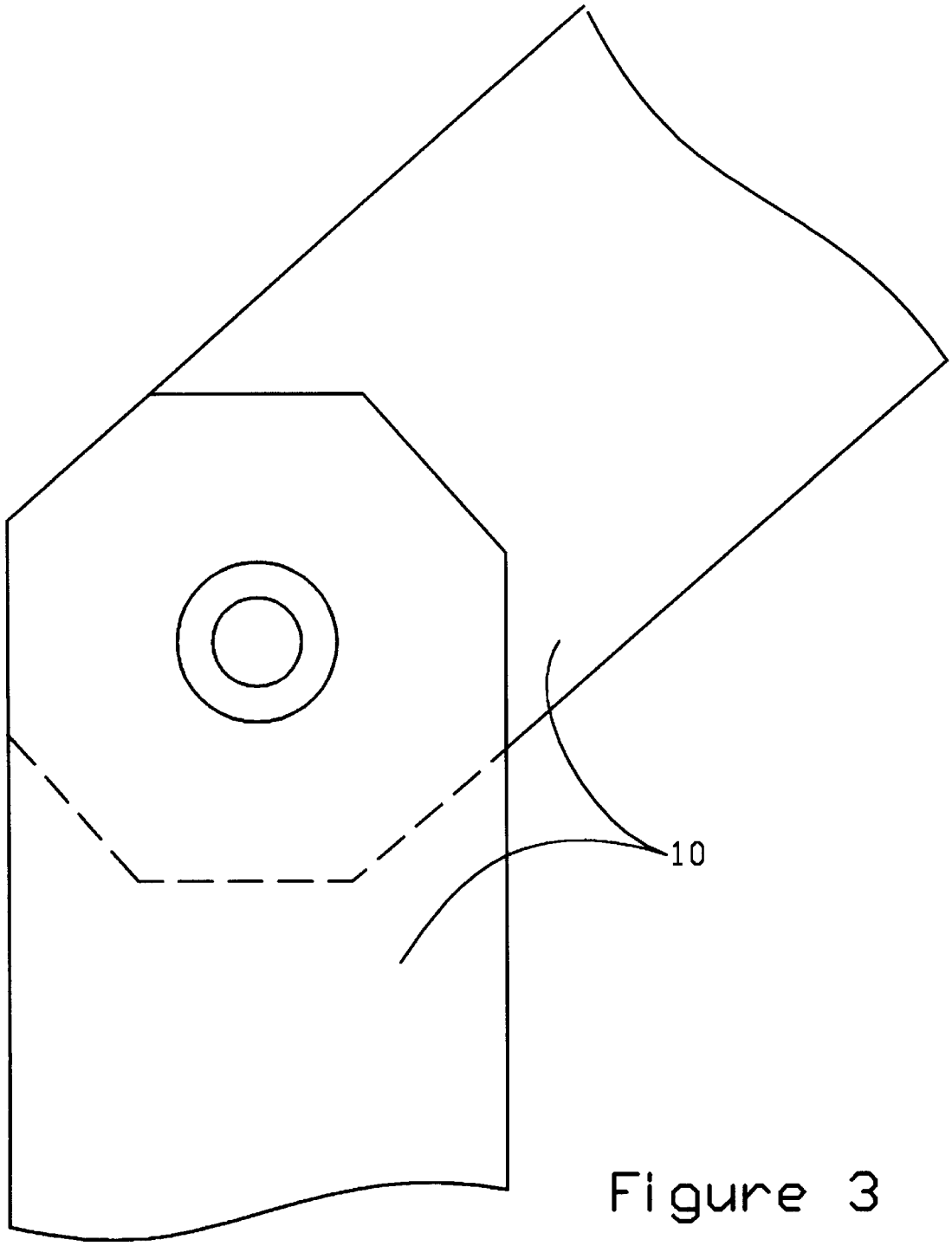
FIG. 3 is a broken view of two strips joined at a forty-five degree angle.

The strip 10 includes multiple fastening means 12. The fastening means 12 are grommets 14 and a hook-and-loop type fastener 16, such as Velcro. Terminal ends 18 of the strip 10 have corners tapered at forty-five degree angles. This allows two strips 10 to be joined at ninety and forty-five degree angles, as shown in FIGS. 2 and 3. If the ends 18 do not include the tapers, the strips 10 can of course still be joined, but the corners of the strips 10 would then protrude beyond the main body of the strips 10.

Figure 5:
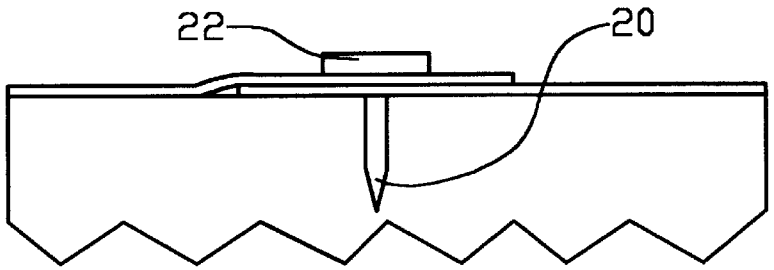
FIG. 5 is a side view of two strips anchored with a stake.
Figure 7:
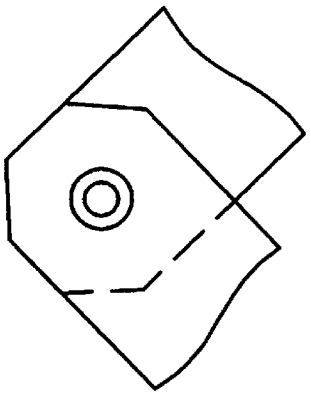
FIG. 7 is a top view of two strips joined at a ninety degree angle.
Figure 4:
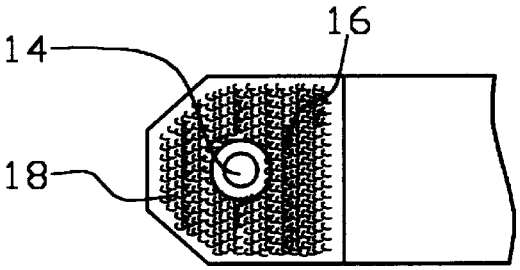
FIG. 4 is a detail view of a terminal end of a strip.

The fastening means 12 are utilized in affixing the strips 10 to a playing area. FIG. 5 illustrates strips 10 joined together by an anchor 20 passing through the grommets 14. The strips 10 are aligned so that their grommets 14 overlap. The anchor 20 is driven through the grommets 14 and into the ground, thereby fixing the strips 10 in place. A large head 22 of the anchor 18 allows a user to insert the anchor into the ground, and after use remove it, by hand.

Figure 6:
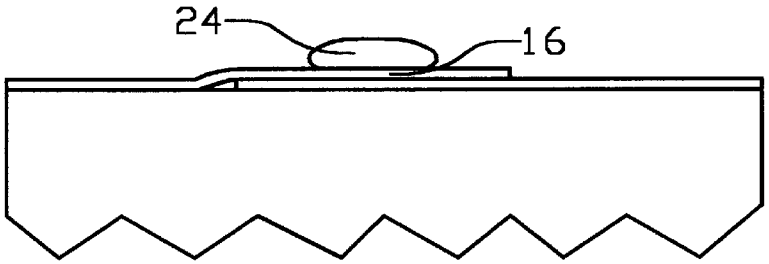
FIG. 6 is a side view of two strips anchored with a weighted pouch and Velcro.

FIG. 6 illustrates placement of the strips 10 using the Velcro 16 and a weight bag 24. After the strips 10 are joined by the Velcro 16, the weight bag 24 is placed on top of the joint to inhibit movement. It is envisioned that this fastening means will be used when the strips are utilized on playing surfaces other than grass.

FIGS. 12–16 illustrate some of the lengths of strips that can be used when laying out boundaries for training according to this invention. FIGS. 17–22 illustrate some of the more common layouts for drills used in training. Although the number of layouts that are possible using this invention is unlimited, these layouts are some of the most widely used.

Figure 8:
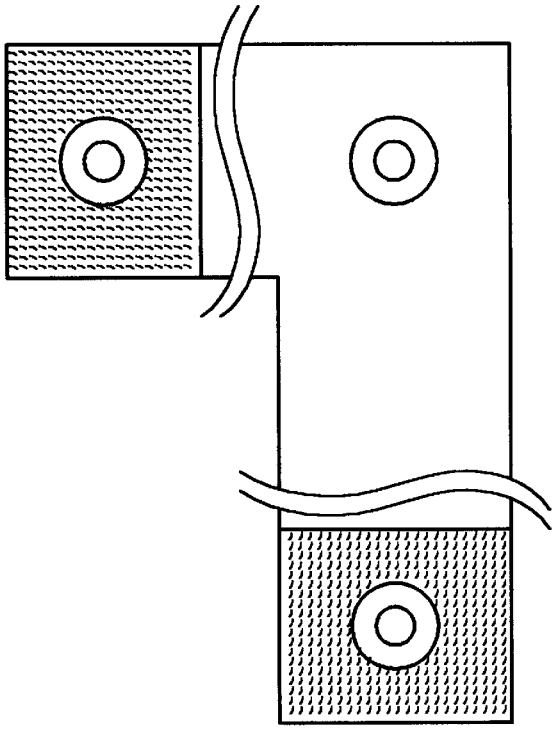
FIG. 8 shows a strip manufactured with a ninety degree turn in the strip.
Figure 9:
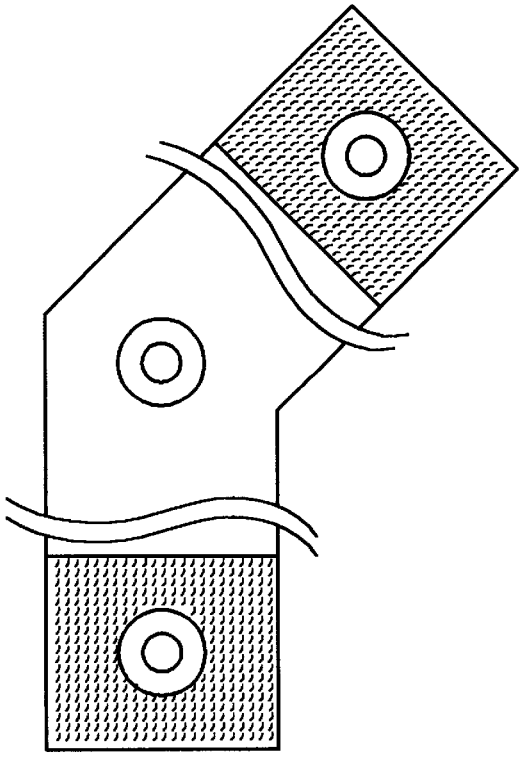
FIG. 9 shows a strip manufactured with a forty-five degree turn in the strip.
Figure 10:
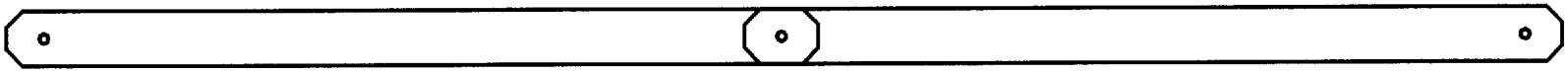
FIG. 10 is a top view of two strips joined end-to-end.
Figure 11:
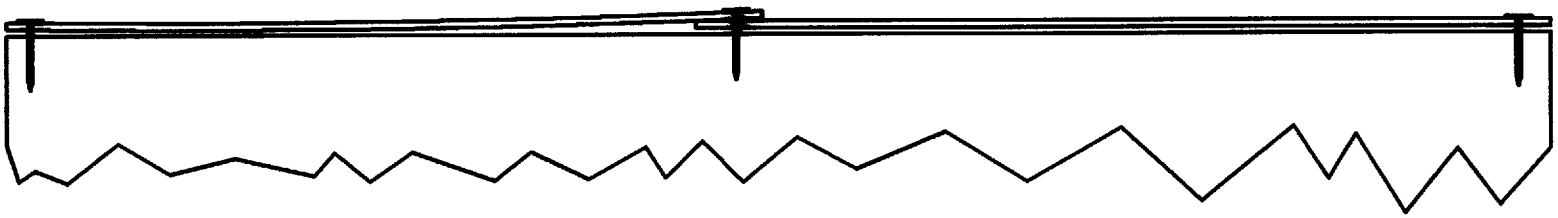
FIG. 11 is a side view of two strips joined end-to-end.
Figures 12, 13, 14, 15, 16, 17:
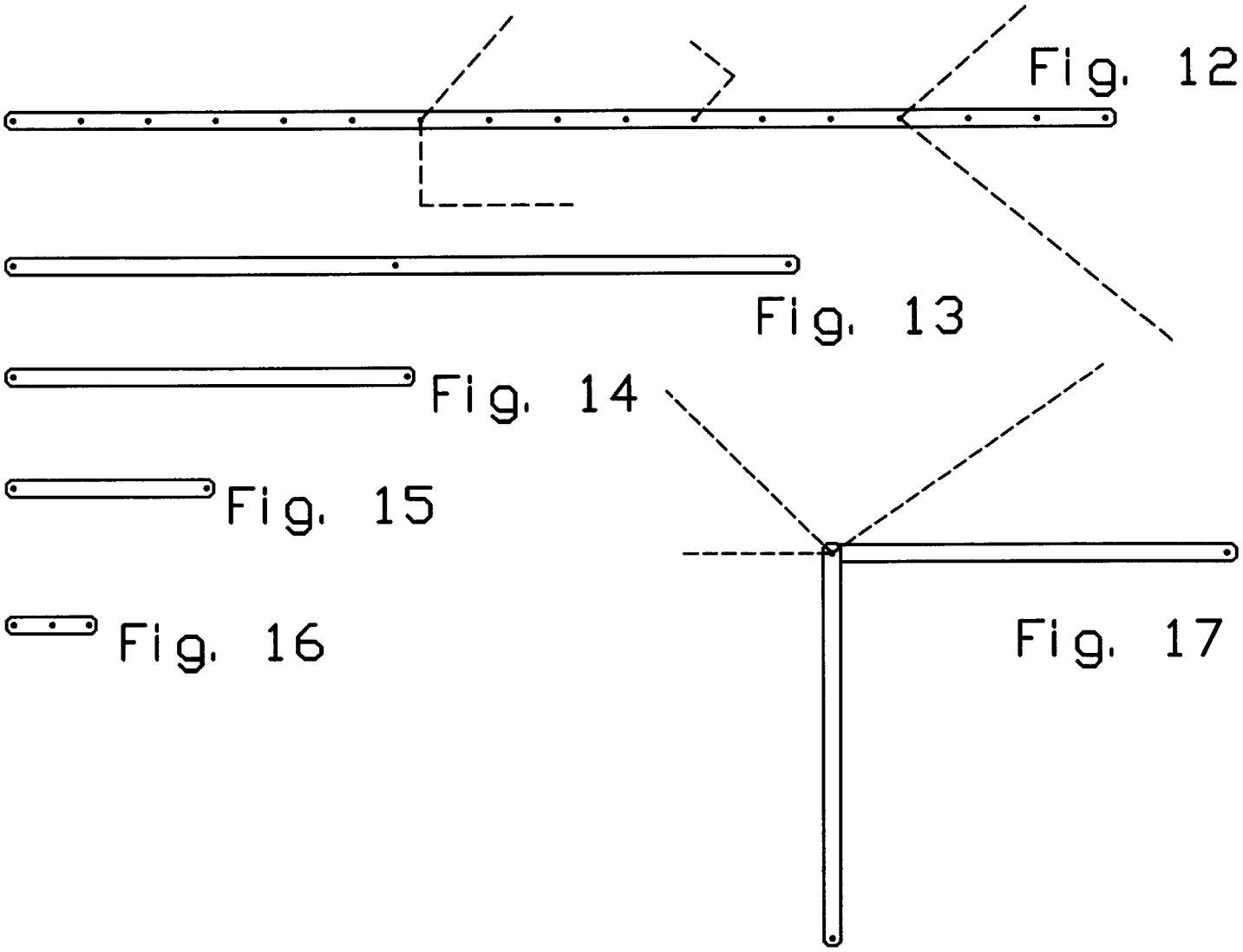
FIG. 12 shows a fifteen yard strip.
FIG. 13 shows a ten yard strip.
FIG. 14 shows a five yard strip.
FIG. 15 shows a three yard strip.
FIG. 16 shows a one yard strip.
FIG. 17 shows two strips joined at a ninety degree angle.
Figure 18:
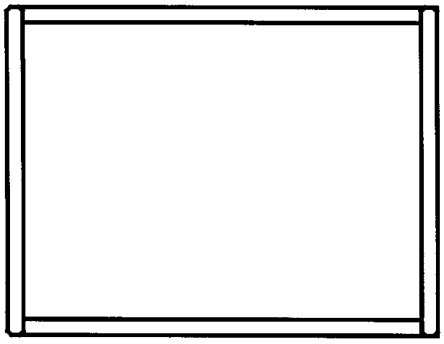
FIG. 18 shows a plurality of strips arranged for a four corner drill.
Figure 19:
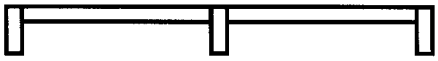
FIG. 19 shows a plurality of strips arranged for a short shuttle drill.
Figure 20:
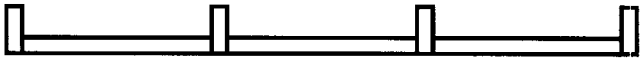
FIG. 20 shows a plurality of strips arranged for a long shuttle drill.
Figure 21:
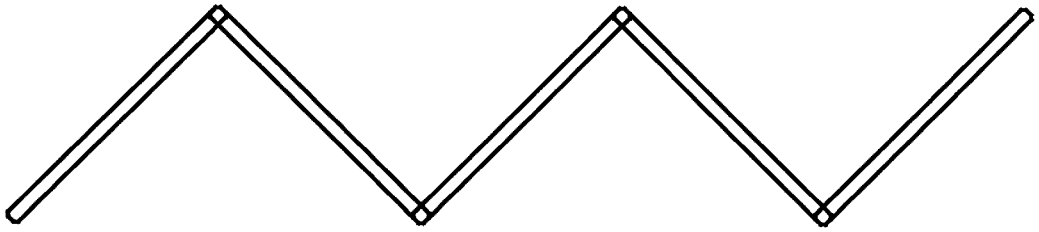
FIG. 21 shows a plurality of strips arranged for a "W" drill (back pedal and sprint).
Figure 22:
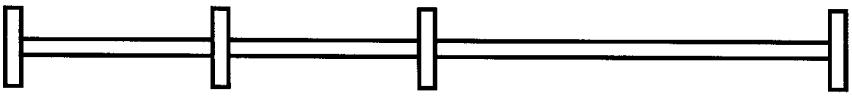
FIG. 22 shows a plurality of strips arranged for a forty yard sprint.

FIGS. 8 and 9 illustrate an alternate embodiment of the present invention. In this alternate embodiment, the strips 10 are manufactured with a ninety degree angle included as in FIG. 8, or with a forty-five degree angle included as shown in FIG. 9. In this embodiment, the terminal ends of the strips do not have to be tapered, as the required bends are already accomplished in the strips themselves.

Any length or width can be used for the strips 10 of the present invention. However, in the preferred embodiment, 3" strips are chosen to simulate yard markers on a football field. The material used is sixteen ounce per square yard triple ply polyester laminated material, with a width of three inches. Note that the attachment and anchoring grommets can be made of any type of material. The preferred embodiment uses a two piece type grommet with a one-half inch opening for anchoring two or more strips together or for attaching the strips to the ground using an anchor.

The anchors can be made of any type of rigid material. The preferred embodiments utilize aluminum or nylon plastic pins as anchors. The Velcro areas can also be used to attach strips to each other and weight bags which are 3 inches by 3 inches are used to secure these Velcro attached strips to areas such as artificial turf, concrete, or wood surfaces.

The grommets will be on a 1½ inch centerline with the end grommets being 1½ inches in from the ends of each strip. The user can at anytime make precise ninety and forty-five degree bends by joining multiple strips. Joining of the strips can be accomplished by either using grommets and anchors or by using Velcro.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

We claim:

1. A playing aid device comprising:

at least one elongated strip of durable material adapted to simulate field markings, each of at least one said strip includes fastening means at each terminal end thereof so that multiple units of said device may be joined together to mark a line of any length desired by a user, said fastening means being constructed such that multiple strips may be secured by the user without the use of tools, said fastening means being hook-and-loop devices and a grommet secured by an anchor device, and joints formed when two strips are joined together are further secured by means of a weighted bag placed thereon.

2. The playing aid device of claim 1 wherein:

said anchor device includes a large head adapted to be grasped by the user for easy insertion and removal.

3. A playing aid device comprising:

at least one elongated strip of durable material adapted to simulate field markings, said strip includes fastening means at each terminal end thereof so that multiple units of the device may be joined together to mark a line of any length desired by a user, said strip having an angle in a main body thereof;

said fastening means being constructed such that said strips are secured to a playing area by the user without the use of tools, said fastening means are hook-and-loop devices and a grommet secured by an anchor device, and junctions formed when two strips are joined together are further secured by means of a weighted bag placed thereon.

4. The playing aid device of claim 3 wherein:

said anchor device includes a large head adapted to be grasped by the user for easy insertion and removal.

5. The playing aid device of claim 3 wherein:

said angle in said main body is zero degrees.

6. The playing aid device of claim 3 wherein:

said angle in said main body is ninety degrees.

7. The playing aid device of claim 3 wherein:

said angle in said main body is forty-five degrees.

* * * * *